United States Patent [19]

Millsaps

[11] 3,990,842

[45] Nov. 9, 1976

[54] AMMONIUM SILICOFLUORIDE ASSISTED DYEING

[75] Inventor: William Alexander Millsaps, East Norristown Twp., Pa.

[73] Assignee: Pennwalt Corporation, Philadelphia, Pa.

[22] Filed: May 15, 1975

[21] Appl. No.: 577,576

[52] U.S. Cl. ..... 8/82; 8/17; 8/21 B; 8/21 C; 8/179

[51] Int. Cl.[2] ..... D06P 1/673

[58] Field of Search ..... 8/82, 17, 21, 179

[56] References Cited

UNITED STATES PATENTS

| | | | |
|---|---|---|---|
| 1,372,038 | 3/1921 | Phair | 8/82 |
| 1,706,325 | 3/1929 | Schafer | 8/94.24 |
| 2,329,651 | 9/1943 | Powers | 8/18 UX |

OTHER PUBLICATIONS

A.A.T.C. Technical Manual, 1966 Edition, p. E159.

*Primary Examiner*—Donald Levy
*Attorney, Agent, or Firm*—Robert G. Danehower

[57] ABSTRACT

Many textile fibers are dyed in dye baths requiring an acidic aqueous medium to give effective dyeing. Dyeing processes and dye baths are disclosed in which the aqueous acidic medium is controlled and the pH adjusted by the use of ammonium silicofluoride.

2 Claims, No Drawings

AMMONIUM SILICOFLUORIDE ASSISTED DYEING

Textile mills in their normal operations use many types of dyes, organic and inorganic dyes for coloring textile fibers. Many of these dyes require the use of acid for pH adjustment of the dye for most effective application.

In addition, in some textile processes, the textiles may carry with them some alkalinity from the proceeding scouring or bleaching operations.

Heretofore, the textile dyeing industry has used mainly organic acids to adjust the acidity of dye baths. The most frequently used organic acids are acetic acid, hydroxyacetic acid or formic acid. These organic acids are corrosive liquids in their concentrated forms and are shipped and stored in glass carboys, drums or tanks. In addition to being corrosive, the liquid acids present the danger of acid burns to mill personnel and accordingly, they require appropriate special safety handling equipment in their transport and use. I have now discovered that ammonium silicofluoride is a highly efficient agent for controlling the acidity of dyeing baths for textiles.

DESCRIPTION OF THE INVENTION

In addition to its effectiveness as a means of pH adjustment ammonium silicofluoride has the decided advantage of being a relatively harmless free flowing dry powder. In the form of a free flowing dry powder it is much more accessible to handling from an open container as compared to acetic acid or other liquid organic acid.

Prior to the dyeing process, most textile fibers are either scoured or bleached or they may be subject to both scouring and bleaching.

A typical scouring process for textiles would be immersion of the textile in an aqueous bath containing wetting agents, sequestrants, alkaline or acidic materials. For example, textile fibers may be scoured with rust removing agents such as oxalic acid or hydrofluoric acid. Immersion of the textile in the scouring bath will be about 30 minutes at about 150° to about 212° F. After scouring, the textile proceeds to the bleaching or dyeing operation.

A typical textile bleaching process for cellulosic or cellulosic-containing blends will use an aqueous bath containing about 3% by weight based on the dry weight of the fabric of hydrogen peroxide in alkaline solution. Bleaching usually requires about 45 to 60 minutes of immersion in the bleach bath at about 150° to 212° F. After bleaching the textile is rinsed in water prior to dyeing.

Surprisingly, of all the silicofluoride salts commercially available, ammonium silicofluoride is the only silicofluoride salt satisfactory for adjusting the acidity of dye baths. For example, zinc silicofluoride introduces undesirable heavy metal cations in the dye bath. Magnesium silicofluoride contributes excessively to water hardness. Sodium silicofluoride is not sufficiently soluble in water for this purpose.

It was also surprising to discover that ammonium silicofluoride when used to adjust the acidity of dye baths would not interfere with uniformity and levelness of dyeing. It is known, for example, that sodium silicate (water glass) frequently used in peroxide bleaching baths for textiles, leaves an uneven deposit of silica on the textiles which if not completely removed in the rinsing process, will when dried lead to erratic or uneven dyeing. Accordingly, it was most unexpected to find that ammonium silicofluoride did not produce any deleterious effects on the dyeing process.

In the practice of my invention textile cloth or yarn is immersed in an aqueous dyeing solution containing wetting agents, dyeing assistants, dyestuff and acidifying agent at a water to fabric ratio of about 20 to 1 to 40 to 1. Heat is applied slowly to prevent too rapid exhaustion of the dye stuff on the textile. Temperatures of 210° to 212° F. are generally used for dyeing and this temperature level is maintained until exhaustion of the dye has been completed. The textile is then after-scoured with hot water usually containing a wetting agent to remove loose dye. This is followed by a water rinse, water extraction and drying.

The dyeing assistants commonly used are sodium chloride and sodium sulfate (Glauber's Salt) at concentrations varying from about 10 to 20% by weight based on the dry fabric weight.

Examples of dyestuffs which generally require an acid medium for effective dyeing results include disperse dyes, acid dyes, basic dyes, chrome dyes, vat dyes and naphthol dyes. The dyestuff is added to the dye bath in a quantity sufficient to produce the shade desired. The concentrations of dyestuff may vary from about 1 to 10% by weight based on dry fiber weight.

Almost any type of wetting agent can be used in the dye bath. The concentration of wetting agent may vary from about 0.25 to 2% by weight based on the dry fiber weight.

The amount of ammonium silicofluoride added to the dye bath will be an amount sufficient to give the dye bath a pH varying from about 3.5 to 6.5.

The following examples illustrate the practice of my invention and set forth the best mode contemplated by me for carrying out the invention:

EXAMPLE 1

After scouring and bleaching, a nylon-cotton blend tape was placed in the alkaline stage of a naphthol coupling bath at a 20 : 1 water to fabric ratio. The alkaline stage of the coupling bath contained 10% by weight of coupler based on the dry fabric weight, 8% by weight of sodium hydroxide based on the dry fabric weight and 20% by weight sodium chloride based on the dry fabric weight. The nylon-cotton tape was treated for 20 minutes at 120° F. in the alkaline coupler bath. The tape was then washed with water containing 20% by weight sodium chloride to set the coupler.

The sodium chloride solution was then squeezed from the tape and the cloth was then immersed in water to which was added the naphthol dye at a concentration of 10% by weight based on the weight of the dry fabric. One (1) percent of 56% acetic acid based on the weight of the dry fabric was added to give the dye bath a pH of about 4.5. After removal from the naphthol dye bath the cloth was treated for 20 minutes with cold water, then washed with hot water, rinsed again with cold water and dried.

Undyed nylon-cotton blend tape identical to that used above was then treated exactly as before up to the point of the addition of acetic acid. At this point, instead of acetic acid, ammonium silicofluoride was added in sufficient quantity to give the dye bath a pH of 4.6. Dyeing was completed exactly as above, and after rinsing and drying the two nylon-cotton tapes were examined. Visual comparisons showed no detectable differences in identity of shade and levelness of dyeing.

EXAMPLE 2

A roll of approximately 1,000 pounds, or 2,000 yards, of 65-35 polyester cotton woven goods was dyed with a disperse and vat dye simultaneously in a Poensgen jig. The polyester portion of the woven goods was dyed with the disperse dye while the cotton was dyed with the vat dye. The disperse dye, the vat dye, a solvent scouring agent and a disperse dye carrier were added to the Poensgen jig. After uniform mixing of the ingredients, approximately 4 ounces of ammonium silicofluoride was added to give the dye bath a pH of 5.4. The dye bath temperature was then raised to about 210° F. and the cloth was passed back and forth on the Poensgen jig in the dye bath until the desired dye shade was obtained. The dark olive dye shade appeared uniform and level throughout the cloth.

EXAMPLE 3

Laboratory tests — Skeins of spun polyester (100%) yarn were wet out in water containing a wetting agent. After wetting, excess water was squeezed out from the skeins. One skein was then dyed in a bath containing a 20 : 1 water to fabric ratio. The dye bath contained a disperse dye at 1 gram per liter, dye carrier at 6 grams per liter, wetting agent at 0.5 grams per liter, 56% acetic acid at 0.4 grams per liter to give a pH of 6.0. The dye was Disperse Blue 81.

A second bath contained Disperse Blue 81 dye at 1 gram per liter, a dye carrier at 6 grams per liter, wetting agent at 0.5 grams per liter and ammonium silicofluoride at 0.16 grams per liter to give a pH of 6.0. One each of the skeins of yarn were placed in the above solutions in a Launderometer for 90 minutes at 205° F. After rinsing with warm water, the dyes were then fixed in an acidified sodium perborate bath for 2 minutes at room temperature, and then rinsed again with warm water. The excess dye was then removed by rinsing the skeins in acid solutions containing a wetting agent for 2 minutes at 180° F., followed by a water rinse, extraction and drying. No detectable differences were noted by visual comparison of the skein dyed in the acetic acid dye bath as compared to the skein dyed in the ammonium silicofluoride dye bath.

Following standard laboratory procedures for dyeing textile fibers similar to the Example above, various types dyes were applied to different types of textile fibers as indicated in the Table below. Each dye was applied in identical solutions to identical yarns or cloths except that in the dyeing procedures one solution used 56% acetic acid to control and adjust the pH while ammonium silicofluoride was used in the second solution to control acidity and adjust pH. All duplicate samples of the textile fibers were washed to remove excess dye, extracted to remove rinse water and air dried. A visual comparison of the dye shade and dye levelness from the dyeing results obtained in each bath was then made. The results are set forth in Table I below.

TABLE I

| | | DYE TESTS | | | | |
|---|---|---|---|---|---|---|
| NO. | FIBER | COLOR INDEX NAME & NUMBER | ACID MATERIAL | AMOUNTS | pH OF DYE BATH | DYEING |
| 1 | Polyester | Disperse Blue 81<br>Anthraquinone class<br>No number | 56% acetic | 0.4 g/l. | 6.0 | uniform and level no observable difference |
| 2 | Polyester | Disperse Blue 81<br>No number | ASF* | 0.16 g/l. | 6.0 | uniform and level no observable difference |
| 3 | Nylon | Acid Red 151<br>Reaction product of p-(p.aminophenylazo)benzene sulfonic acid and 2 naphtol<br>26900 | 56% acetic | 2% wt. fiber | 5.2 | uniform and level no observable difference |
| 4 | Nylon | Acid Red 151<br>26900 | ASF | 0.75% wt. fiber | 5.2 | uniform and level no observable difference |
| 5 | Acrylic | Basic Blue 54<br>monoazo class<br>11052 | 56% acetic | 3 g/l. | 4.1 | uniform and level no observable difference |
| 6 | Acrylic | Basic Blue 54<br>11052 | ASF | 0.84 g/l. | 4.3 | uniform and level no observable difference |
| 7 | Wool | Acid Red 151<br>26900 | 56% acetic | 2% wt. fiber | 5.2 | uniform and level no observable difference |
| 8 | Wool | Acid Red 151<br>26900 | ASF | 0.75% wt. fiber | 5.2 | uniform and level no observable difference |
| 9 | Wool | Mordant Brown 13<br>13225 | 56% acetic | (amounts not available) | 4.5 | uniform and level no observable difference |
| 10 | Wool | Mordant Brown 13<br>Reaction product of 2-amino-1-phenol-4-sulfonic acid and m-phenylenediamine<br>13225 | ASF | (amounts not available) | 4.6 | uniform and level no observable difference |
| 11 | Cotton | Vat Brown 20<br>Anthraquinone class<br>No number | 56% acetic | 0.97 g/l. | 3.8 | uniform and level no observable difference |
| 12 | Cotton | Vat Brown 20<br>No number | ASF | 0.32 g/l. | 4.0 | uniform and level no observable difference |
| 13 | Cotton | Azoic Diazoic 13<br>5-nitro-o-anisidine<br>37130 | 56% acetic | 1% on wt fiber | 4.1 | uniform and level no observable difference |
| 14 | Cotton | Azoic Diazoic 13<br>37130 | ASF | 0.2% on wt. fiber | 4.0 | uniform and level no observable |

TABLE I-continued

| NO. | FIBER | COLOR INDEX NAME & NUMBER | DYE TESTS ACID MATERIAL | AMOUNTS | pH OF DYE BATH | DYEING difference |
|---|---|---|---|---|---|---|

*ASF = Ammonium silicofluoride

I claim:

1. In the process of dyeing textile fibers by immersing them in an aqueous dye bath requiring adjustment of acidity for effective dyeing the improvement consisting of adding ammonium silicofluoride to the said dye bath sufficient to adjust the pH within the range of about 3.5 to 6.5.

2. An acidic aqueous bath for dyeing textile fibers containing dye, water and ammonium silicofluoride in an amount sufficient to give the dye bath a pH within the range of about 3.5 to 6.5.

* * * * *